US008079860B1

(12) United States Patent
Zraik

(10) Patent No.: US 8,079,860 B1
(45) Date of Patent: Dec. 20, 2011

(54) CABLE CONNECTOR HAVING THREADED LOCKING COLLET AND NUT

(75) Inventor: Souheil Zraik, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/841,672

(22) Filed: Jul. 22, 2010

(51) Int. Cl.
*H01R 4/38* (2006.01)

(52) U.S. Cl. ..... 439/255

(58) Field of Classification Search ..... 439/352, 439/255, 254, 256, 312, 322
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |

(Continued)

FOREIGN PATENT DOCUMENTS

CA 2096710 A1 11/1994

(Continued)

OTHER PUBLICATIONS

Digicon AVL Connector. ARRIS Group Inc. [online]. 3 pages. [retrieved on Apr. 22, 2010]. Retrieved from the Internet:< URL: http://www.arrisi.com/special/digiconAVL.asp>.

*Primary Examiner* — Phuong Dinh
(74) *Attorney, Agent, or Firm* — Schmeiser, Olsen & Watts

(57) ABSTRACT

A connector for a coaxial cable includes a connector body and a post having a flanged end as well as a coupling nut rotatably attached to the flanged end of the post. The flanged end of the post is defined by an open-ended port retaining portion having an exterior threaded surface that is engaged by respective internal threads of the coupling nut. The port retaining portion defines a locking collet that enables exterior ports of varying diameters to be engaged with and secured to the connector.

10 Claims, 10 Drawing Sheets

U.S. PATENT DOCUMENTS

| | | | |
|---|---|---|---|
| 3,373,243 | A | 3/1968 | Janowiak et al. |
| 3,390,374 | A | 6/1968 | Fomey, Jr. |
| 3,406,373 | A | 10/1968 | Fomey, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Fomey, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |

4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A * 3/1993 Szegda ..... 439/394
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson

| | | | |
|---|---|---|---|
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,777 | A | 4/2000 | Boyle |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,676,446 | B2 | 1/2004 | Montena |
| 6,683,253 | B1 | 1/2004 | Lee |
| 6,692,285 | B2 | 2/2004 | Islam |
| 6,712,631 | B1 | 3/2004 | Youtsey |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,767,248 | B1 | 7/2004 | Hung |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |
| 6,848,940 | B2 | 2/2005 | Montena |
| 6,884,113 | B1 | 4/2005 | Montena |
| 6,884,115 | B2 | 4/2005 | Malloy |
| 6,929,508 | B1 | 8/2005 | Holland |
| 6,939,169 | B2 | 9/2005 | Islam et al. |
| 6,971,912 | B2 | 12/2005 | Montena et al. |
| 7,029,326 | B2 | 4/2006 | Montena |
| 7,070,447 | B1 | 7/2006 | Montena |
| 7,086,897 | B2 | 8/2006 | Montena |
| 7,097,499 | B1 | 8/2006 | Purdy |
| 7,102,868 | B2 | 9/2006 | Montena |
| 7,114,990 | B2 | 10/2006 | Bence et al. |
| 7,118,416 | B2 | 10/2006 | Montena et al. |
| 7,125,283 | B1 | 10/2006 | Lin |
| 7,131,868 | B2 | 11/2006 | Montena |
| 7,147,509 | B1 | 12/2006 | Burris et al. |
| 7,156,696 | B1 | 1/2007 | Montena |
| 7,161,785 | B2 | 1/2007 | Chawgo |
| 7,229,303 | B2 | 6/2007 | Vermoesen et al. |
| 7,252,546 | B1 | 8/2007 | Holland |
| 7,255,598 | B2 | 8/2007 | Montena et al. |
| 7,299,550 | B2 | 11/2007 | Montena |
| 7,393,245 | B2 | 7/2008 | Palinkas et al. |
| 7,452,239 | B2 | 11/2008 | Montena |
| 7,476,127 | B1 | 1/2009 | Wei |
| 7,479,035 | B2 | 1/2009 | Bence et al. |
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,794,275 | B2 | 9/2010 | Rodrigues |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,874,870 | B1 | 1/2011 | Chen |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2006/0110977 | A1 | 5/2006 | Mathews |
| 2006/0154519 | A1 | 7/2006 | Montena |
| 2007/0026734 | A1 | 2/2007 | Bence et al. |
| 2008/0102696 | A1 | 5/2008 | Montena |
| 2009/0029590 | A1 | 1/2009 | Sykes et al. |
| 2009/0098770 | A1 | 4/2009 | Bence et al. |
| 2010/0081321 | A1 | 4/2010 | Malloy et al. |
| 2010/0081322 | A1 | 4/2010 | Malloy et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |

| | | | |
|---|---|---|---|
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

* cited by examiner

CABLE CONNECTOR HAVING THREADED LOCKING COLLET AND NUT

FIELD OF THE INVENTION

The present application generally relates to the field of coaxial cable connectors and more specifically relates to a coaxial cable connector, which can reliably receive and be secured with interface ports of varying sizes.

BACKGROUND OF THE INVENTION

Coaxial cable connectors are commonly known for a number of applications including broadband and CATV communications, among others. These forms of cable connectors enable electrical connection with various electronic devices, such as televisions, computers, as well as other appliances and/or interfaces. In one known version, a coaxial cable connector, such as a compression-type connector, is provided with a rotatable coupling nut having a set of internal threads that engage with corresponding threads that are provided on a complementary interface port, provided on the appliance or device, in order to integrate a coaxial cable secured by the connector with various electronic and communication apparatus. The coupling nut is rotated about the externally threaded interface port to provide mechanical engagement. As the coupling nut is tightened, the interface port is secured to the connector wherein an radial end facing surface of the interface port engages directly with a flange of a post of the connector onto which the prepared coaxial cable end is secured, thereby ensuring a suitable mechanical as well as electrical connection is maintained once the connector is tightened.

Though the above form of cable connectors are useful, it is known that interface ports may have different dimensions depending upon their specific application or intended use. To that end, there may be issues relating to tightening of the cable connector as well as proper mechanical and electrical mating therebetween. In addition, there may also be concerns to verify that a proper coaxial cable connector is used in connection with the interface port of interest.

In addition, a general concern in the field of connectors relates to effectively maintaining electrical continuity. In the above-noted forms of coaxial cable connectors, loosening of the connection between an external port and the connector can conceivably prevent shielding wherein noise and other electrical interference results. As noted above, effective electrical continuity is realized only when the radial end face of the interface port is compressively engaged with the post flange. It would therefore also be beneficial to provide a coaxial cable connector that better maintains electrical continuity, even in those instances in which the connection is not optimally tight.

SUMMARY OF THE INVENTION

Therefore and according to one aspect, there is provided a coaxial cable connector, said connector comprising a connector body, a coupling nut, and a post. The coupling nut is threadingly connected to a flanged part of the post and is freely rotatable and axially movable therewith.

The flanged part of the post includes a locking collet having an external threaded surface that is engaged by corresponding internal threads of the coupling nut. The coupling nut, when rotated, causes greater or lesser amounts of radial movement of a set of defined spring fingers defining the locking collet, and therefore, permits engagement with varying sized port outer diameters that are engaged therewith. In operation, the user pushes the cable connector onto the interface port of interest and turns the coupling nut until tight, thereby creating secure engagement without damage to the threads of the port. The port can be easily released from the connector by subsequently loosening the coupling nut. The post is preferably made from an electrically conductive material, therefore electrical continuity is consistently maintained between the engaged external port and the connector throughout engagement.

According to another aspect there is provided a connector for a coaxial cable, said connector comprising a connector body having opposing first and second ends and a central bore therethrough, a post having a first end fitted within said connector body for engaging a prepared coaxial cable end, and a coupling nut. The coupling nut receives a second end of the post and is freely rotatable. The first end of the post includes an open-ended port receiving portion or socket having an external threaded surface for engaging internal threads of the coupling nut. An external port whether threaded or not can be secured to the connector by engagement of the coupling nut in which the open-ended port retaining portion radially engages the port and secures same.

The herein defined connector design accounts for differentiation between various sized interface ports in relation to a single coaxial cable connector. This connector also provides suitable electrical continuity between the connector and an external port, but without requiring complete tightening of the connector thereupon. As a result, a larger range of external interface ports can be easily and securely adapted and properly maintained with adequate mechanical as well as electrical connection.

Another advantage of the herein described coaxial cable connector is improved ease of use and versatility.

Still another advantage overall simplicity, thereby creating reduced costs in terms of manufacture and savings to the consumer.

These and other technical features and advantages will be apparent from the following Detailed Description, which should be read in conjunction with the accompanying drawings.

DETAILED DESCRIPTION

The following description relates to a coaxial cable connector that can adaptively and reliably retain a plurality of external interface ports of varying sizes (i.e. diameters) and types in secure fashion without compromising mechanical or electrical integrity as well as maintaining consistent electrical continuity. Though the following embodiment specifically relates to certain compression-type coaxial cable connectors, it will be readily apparent that other connector designs, for example, such as F-type, RCA and BNC-type connectors, among others, can easily be utilized herein as well as other forms of connectors that can be threadingly attached to an external port. In addition, several terms are used throughout this description in order to provide a suitable frame of reference with regard to the accompanying drawings such as "distal", "proximal", "inner", "outer", and the like. These terms, however, are not intended to be overlimiting of the herein described inventive concepts, except where so specifically indicated.

Figure 1:
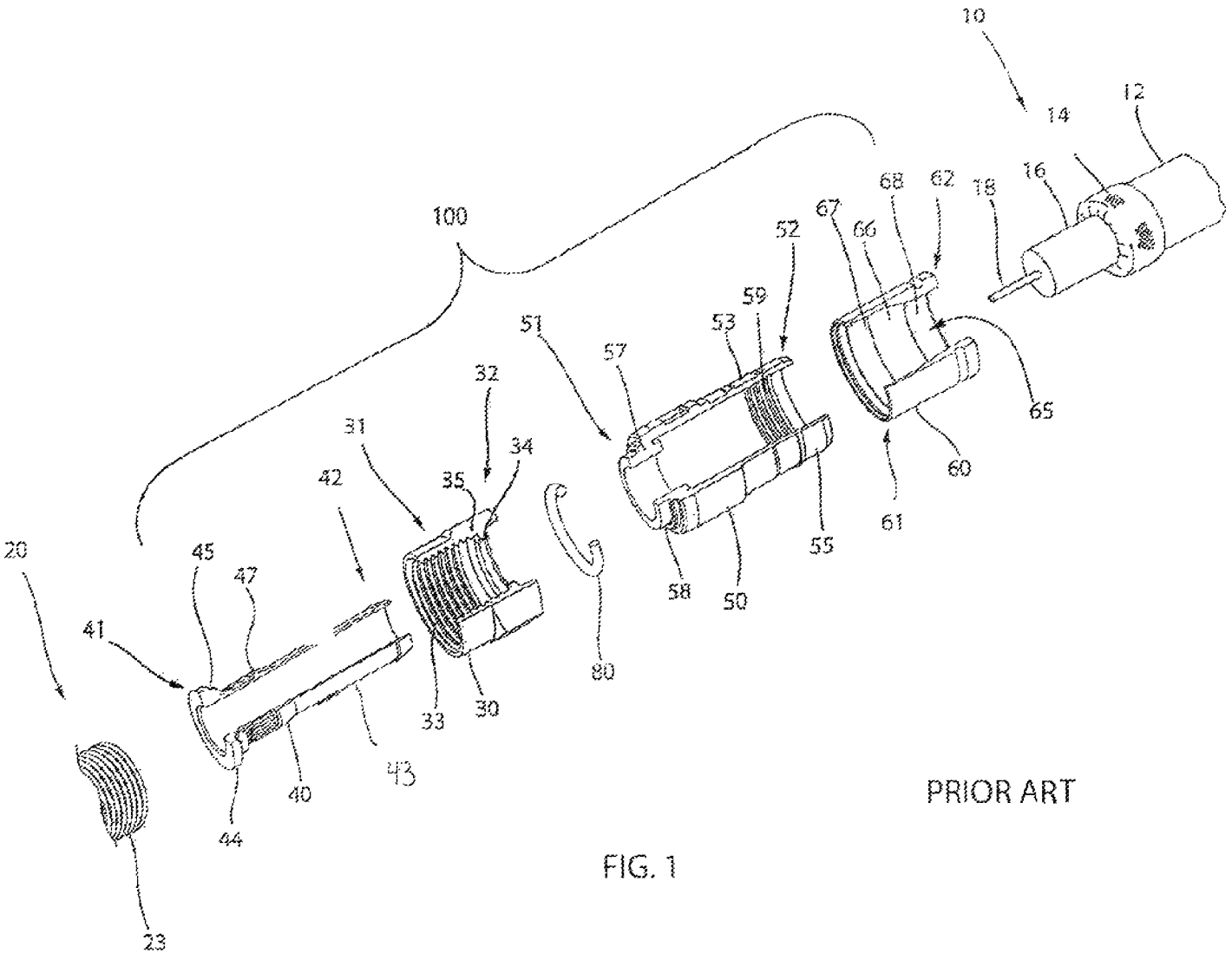
PRIOR ART FIG. 1
FIG. 1 is an exploded assembly view of a coaxial cable connector made in accordance with the prior art.
Figure 2:
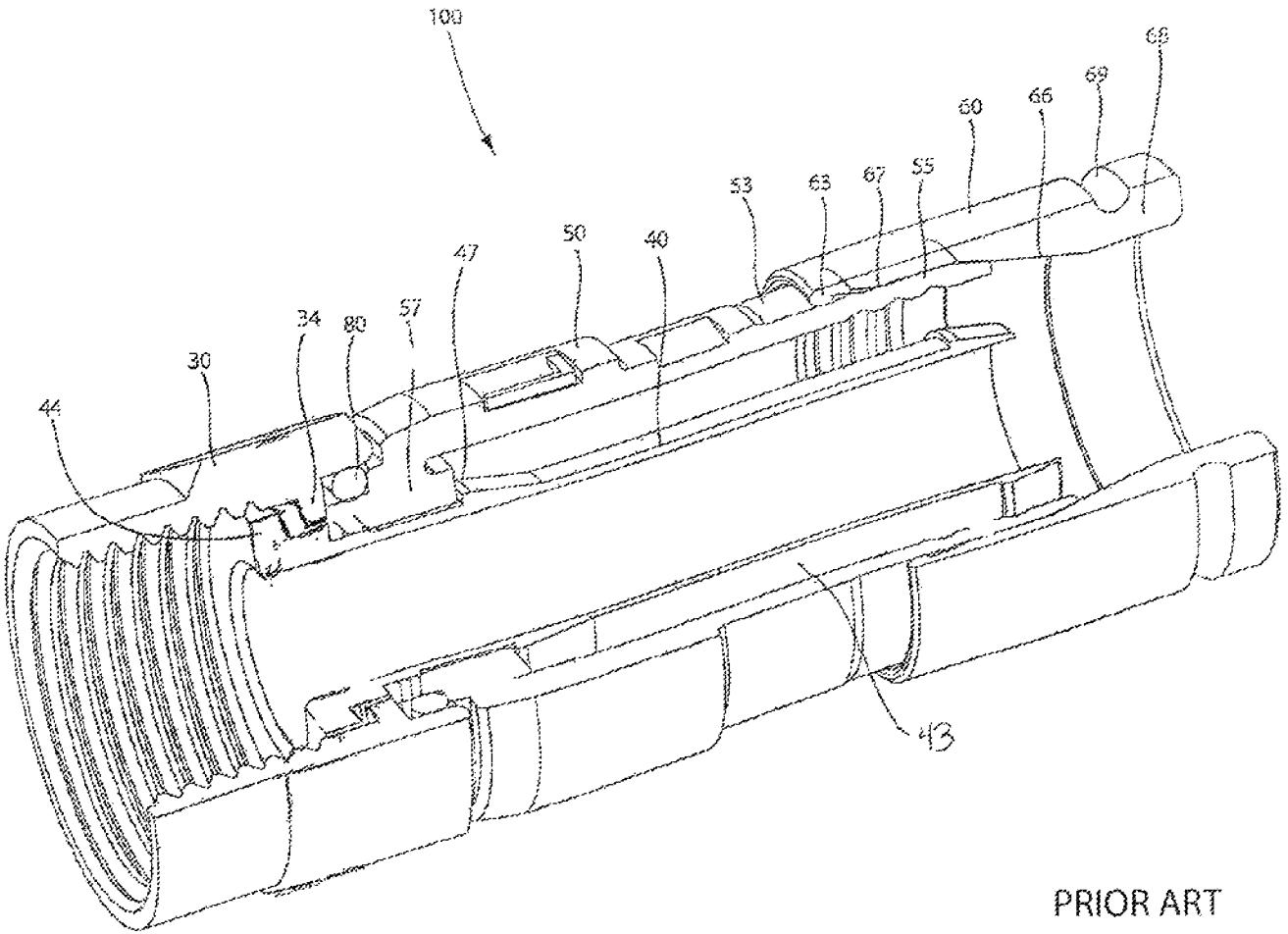
PRIOR ART FIG. 2
FIG. 2 is an assembled view of the coaxial cable connector of FIG. 1.

For purposes of providing a suitable initial background and prior to describing the exemplary embodiment, reference is first made to FIGS. 1 and 2 that depict a prior art coaxial cable connector. This coaxial cable connector, hereinafter labeled with reference numeral 100, is shown in FIG. 1 in exploded form. The connector 100 is defined by an assemblage having a number of discrete components that can be operably affixed to the end of a coaxial cable 10, the cable having a protective outer jacket or sleeve 12, a conductive grounding shield 14, an interior or intermediate dielectric layer 16 and a center conductor 18. The end of the coaxial cable 10 can be drawn back, as represented in FIG. 1, by removing an axial portion of the protective outer jacket 12 and then drawing back the conductive grounding shield 14, which may be braided, in order to expose an axial portion of the intermediate dielectric layer 16. Additional preparation of the coaxial cable 10 can include stripping or coring the intermediate dielectric layer 16 in order to expose a portion of the center conductor 18.

As noted, the connector 100 includes discrete components which, for purposes of this typical connector 100, include a threaded nut 30, a post 40, a connector body 50, a compression member or sleeve 60 and a connector body sealing member 80, such as an O-ring.

The components of the coaxial cable connector of FIGS. 1 and 2 are now briefly described, as follows: First, the threaded nut 30 according to this version is formed from an electrically conductive material, the nut having a first end 31 and an opposing second end 32. A set of internal threads 33 extend from the edge of the first end 31 over a sufficient axial distance that permits effective threaded contact with the external threads 23 of a standard coaxial cable interface port 20 (shown partially in FIG. 1). The nut 30 further includes an internal lip 34, in this instance an annular protrusion, which is disposed proximate the second end 32, therein defining a flange.

The post 40 is a rigidly formed body made according to this version at least partially from an electrically conductive material and defined by a first end 41 and an opposing second end 42. A flange 44, such as an externally extending annular protrusion, is located at the first end 41 of the post 40 and defined by an annular shoulder 45. The post 40 further includes a hollow shaft portion 43 having a substantially constant and cylindrical cross section extending from the second end 42 to a tapering portion having at least one exterior surface feature 47 intermediately disposed in relation to the first end 41. When assembled, portions of the prepared coaxial cable end 10, including the intermediate dielectric layer 16 and the center conductor 18, are permitted to pass into the second end 42 through the hollow confines of the shaft portion 43 of the post 40 while the outer sleeve 12 and shielding layer 14 are caused to be stripped by the second end 42 of the post, as described briefly below.

Still referring mainly to FIG. 1, the connector body 50 includes a first end 51 and an opposing second end 52, wherein the connector body is substantially hollow and defined by an center passageway or bore. Adjacent the first end 51 of the connector body 50 is a post mounting portion 57 that is configured to mate with the at least one exterior surface feature 47 of the post 40, enabling the post to be axially as well as radially secured to the connector body. In addition, the connector body 50 includes an outer annular recess 58 located proximate the first end 51 which permits the inclusion of the sealing member 80, which is an O-ring, as shown in FIG. 2. A portion 53 of the connector body 50 is formed from a semi-rigid, yet compliant outer surface 55, this portion being configured to form an annular seal when the second end 52 is deformably compressed against a retained coaxial cable 10 by operation of the compression member 60, as described in greater detail below.

The compression member 60 according to this known connector version is defined by a cylindrical sleeve-like section that further includes opposing first and second ends 61, 62, respectively. The first and second ends 61, 62 are interconnected by means of a center passageway 65, the passageway having a plurality of sections including a first diametrical section 67 adjacent the first end 61 having a first inner diameter and a second diametrical section 68 adjacent the second end having a second inner diameter that is smaller than the first inner diameter. A transitional section 66, provided intermediate the first and second diametrical sections 67, 68, is defined by an interior ramped surface.

The herein described coaxial cable connector 10, still referring to FIGS. 1 and 2, serves to securably retain a prepared coaxial cable end 10. In this configuration, the prepared coaxial cable end 10, including an extending axial section of the center conductor 18, is inserted into the interior of the connector body 50 through the second end 52 thereof as well as through the center passageway 65 of the compression member 60. The first end 42 of the post 40, fitted and secured into the confines of the connector body 50 engages the coaxial cable end 10 between the cored dielectric layer 16 and the grounding shield layer 14. According to this version, the compression member 60 is then axially advanced over the exterior of the compression body 50 by means of a compression tool (not shown) or otherwise, causing the interior ramped surface of the compression member 60 to engage and compress the deformable axial portion 53 of the connector body 20 in a radial inward fashion thereby securing the coaxial cable end 10 within the connector 100. The cable is not shown in FIG. 2. The dielectric layer 16 and center conductor 18 are each advanced into the shaft portion 43 of the post, while the outer sleeve 12 and the shielding layer 14 of the advanced coaxial cable 10 are additionally stripped by means of the post and the action of the compression tool (not shown) and the advancing compression member 60, which passes axially over the exterior of the connector body 50.

In the meantime and as most clearly shown in FIG. 2, the coupling nut 30 of the herein described coaxial connector 100 is secured to first end 41 of the post 40 and is mounted thereto so as to permit free rotation, while the center conductor 18 (not shown in this view) extends through the post flange 44 and outwardly from the coupling nut. More specifically and according to this prior art version, the coupling nut 30 is permitted limited axial movement through rotation thereof, wherein the nut flange 34 is caused to engage directly with the annular flange 44 of the post 40 as a mechanical stop as the nut is engaged with an external interface port 20, FIG. 1.

External threads 23 of the external interface port 20 are then threadingly engaged with the internal threads 33 of the coupling nut 30 of the herein described connector 100, causing the coupling nut to be secured thereupon through limited axial movement of the threaded nut as the lip 34 of the nut engages the flange 44 of the post 40. Electrical continuity is initiated based upon compressive contact that is created between the annular flange 44 of the post 40 and an end radial face of the interface port 20, when the coupling nut 30 has been fully tightened. As noted and though effective, the above coaxial cable connector 10 relies upon specific tolerance matchups between the external interface port 20 and the coupling nut 30 of the coaxial cable connector 100 in order to properly provide an effective connection therebetween. There is no permissible variability for this herein described coaxial cable connector 100, however, to accommodate various sized external interface ports.

Figure 3:
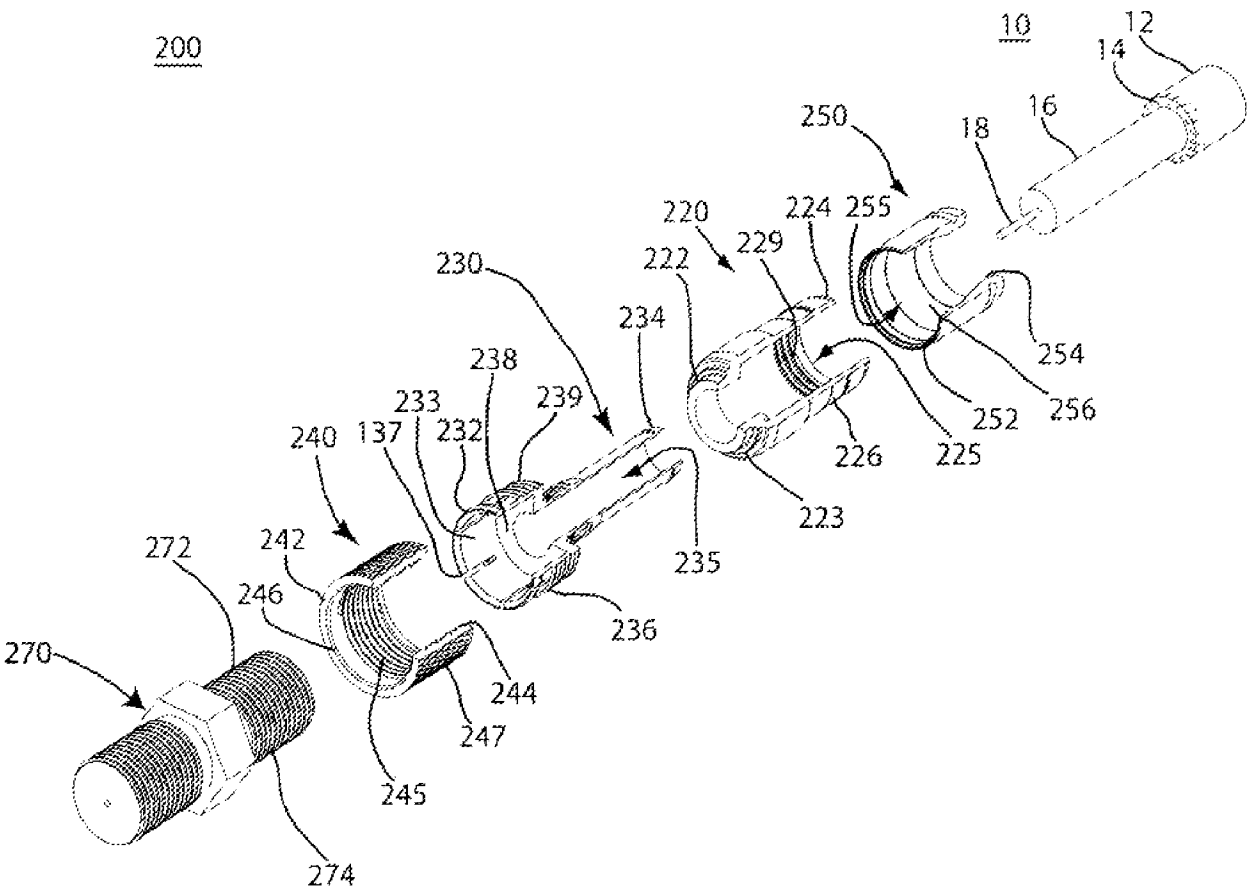
FIG. 3 is an exploded partially broken away perspective view of a coaxial cable connector that is made in accordance with an exemplary embodiment of the present invention.
Figure 4:
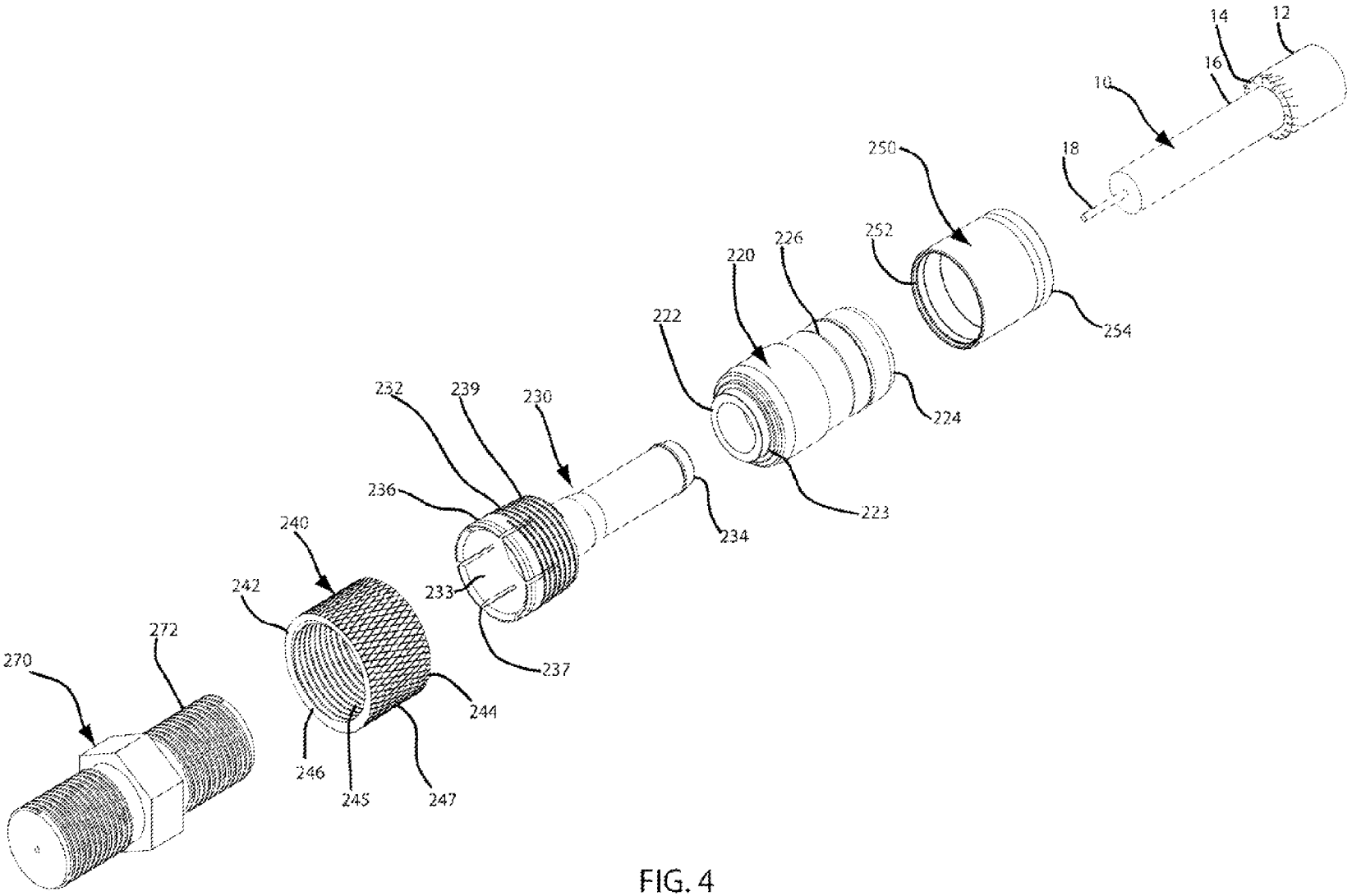
FIG. 4 is the exploded perspective view of the coaxial cable connector of FIG. 3.

Referring now to FIGS. 3-10, a coaxial cable connector in accordance with the present invention is described in accordance with an exemplary embodiment. Referring first to FIGS. 3 and 4, exploded views illustrates the coaxial cable connector (herein labeled with the reference numeral 200) for receiving and securement of a prepared coaxial cable end 10. The connector 200 according to this exemplary embodiment is also a compression-type coaxial cable connector, which like the preceding prior art version is an assemblage that is defined by a number of components, including a connector body 220, a post 230, a coupling nut 240 and a compression member 250.

Referring to FIGS. 3 and 4, the connector body 220 according to this exemplary embodiment is defined by a substantially cylindrical member, including respective opposite first and second ends 222, 224, as well as a center passageway 225 (labeled only in FIG. 3), the latter being defined by adjacent bores having different diameters. In addition and adjacent the first end 222 of the connector body 220 is a post mounting portion 223. The post mounting portion 223 is a narrowed or necked portion of the connector body 220 that is configured to axially secure the post 230 when the post is advanced into the body a predetermined axial distance so as to provide securement thereto. For purposes herein, the connector body 220 can be formed by any convenient process, and be made from conductive or non-conductive materials or alternatively from a combination of conductive and non-conductive materials.

An axial exterior portion 226 adjacent the second end 224 of the connector body 220 is made from a deformable material that permits compression under applied radial pressure, promoting formation of an annular seal. An annular detent or other feature is located on the exterior surface of the connector body 220 proximate the second end 224 and the internal surface of the body includes a plurality of surface features, such as annular serrations 229 (shown only in FIG. 3), also disposed proximately in relation to the second end of the connector body 220.

Still referring to FIGS. 3 and 4, the post 230 of the herein described connector 200, according to this specific embodiment, is defined by a substantially tubular body having a first end 232 and an opposite second end 234, the post being made from a substantially rigid metallic material, such as brass or steel, which is electrically conductive. Alternatively, the post 230 can be made from a combination of conductive and non-conductive materials; for example, a metal coating or conductive outer layer can be applied to an inner polymer core that is made from another material that is non-conductive. The second end 234 of the post 230 is sized to be fitted within the post securing portion 230 and into the center passageway 225 of the connector body 220 for engaging a prepared coaxial cable end 10 so as to engage with and provide substantial electrical and mechanical contact between the grounding shield layer 14 of a prepared coaxial cable end 10 and the tubular post 230, thereby grounding same. At least one external surface feature, such as a lip or protrusion (not shown), may engage the post mounting portion 223 of the connector body 220 to enable axial securement of the post 230. Alternatively, such a feature is not necessary wherein the coaxial cable 10 is secured either by means of a friction fit or press fit or use of other component features or structure in order to maintain the post 230 axially and rotationally in place in the connector 200. A center passageway 235 extends between the flanged first end 232 and the opposite second end 234 of the post 230, wherein the former is defined by an open-ended port retaining portion or socket 236.

Figure 5:
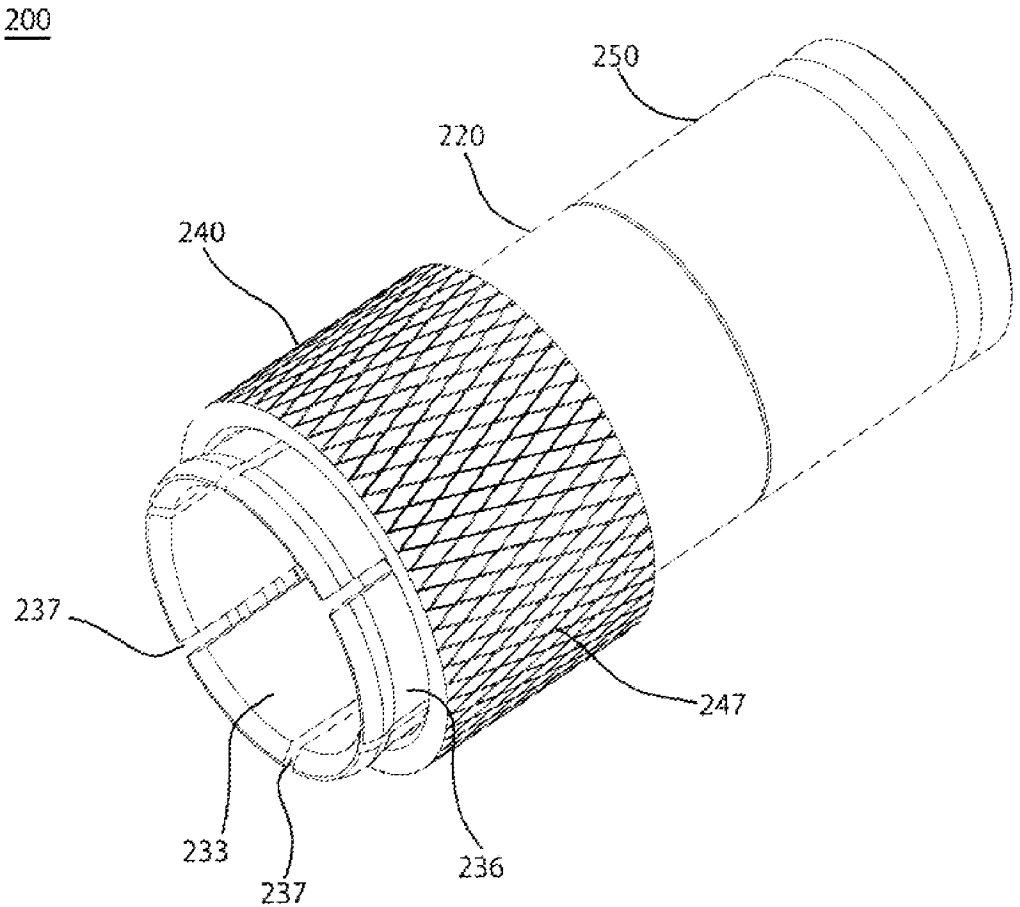
FIG. 5 is a perspective view of the coaxial cable connector of FIGS. 3 and 4 in an assembled condition.

Referring to FIGS. 3-5, the socket 236 according to this embodiment is defined by a cylindrical receiving cavity and a peripheral wall, the peripheral wall being further defined by a plurality of spaced axial slots 237 that extend proximally from a distal end of the socket. The number of axial slots 237 of the socket 236 can be suitably varied as well as the spacing therebetween. According to this exemplary embodiment, six (6) axial slots 237 are disposed at equal 60° intervals from one another about the periphery of the peripheral wall defining the open-ended port retaining portion 236. These axial slots 237 and bordering circumferential sections of the peripheral wall collectively form a set of flexible spring fingers and therefore a locking collet, the slots extending to an intermediate axial length from the distal end of the socket 236.

According to this exemplary embodiment, the exterior surface of the peripheral wall of the socket 236 further includes a set of threads 239, the threads having a suitable pitch and height that complement a set of internal threads 245 provided on the coupling nut 240 in order to enable the coupling nut to be rotatably secured thereupon as described in greater detail below. The post 230 further includes a radial end edge 238, which forms the "bottom" surface of the cylindrical cavity of the socket 236, the edge including an opening extending into the center passageway 235, as most clearly shown in FIG. 5. The radial end edge 238 is configured to provide a mechanical stop for an engaged external interface port 270, as described in greater detail below.

Referring back to FIGS. 3 and 4, the compression member 250 according to this specific embodiment is a substantially cylindrical or sleeve-like section that is defined by a first end 252 and a second opposing end 254, wherein the member is substantially hollow and includes a central passageway 255 extending therethrough. The central passageway 255 includes an interior ramped surface 256, transitioning a pair of diametrical axial portions, the ramped surface tapering generally from a larger interior diameter at the first end 252 to a smaller interior diameter at the second opposite end 254. According to this version, an annular protrusion formed on the exterior surface of the compression member 250 proximate the first end 252 is sized to mate with an annular detent or other feature that is formed on the exterior surface 228 of the connector body 220. Typically, the compression member 250 is formed from a metal, such as brass, but it will be readily apparent that other materials could be used.

Figure 6:
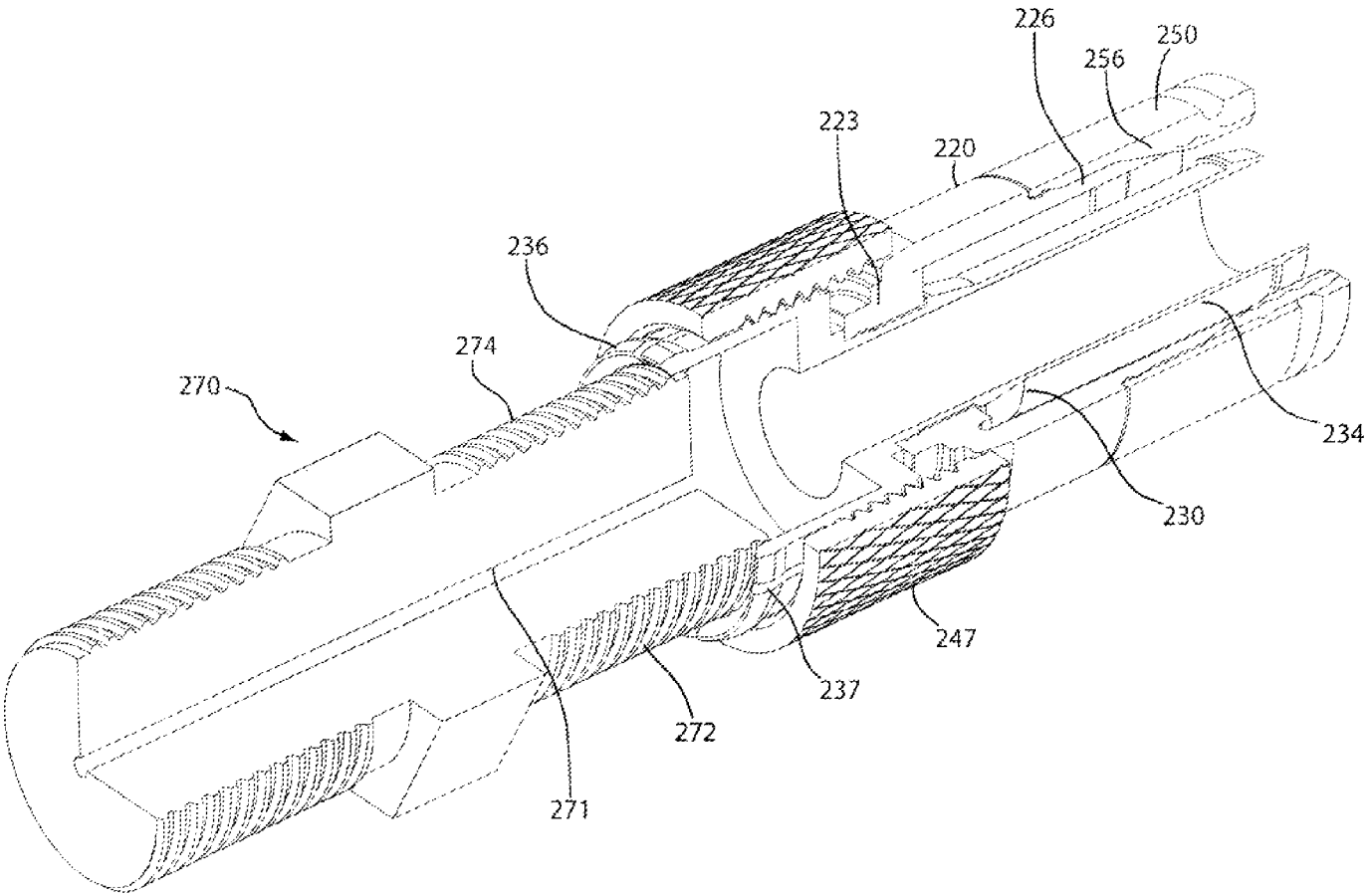
FIG. 6 is a side perspective view, shown in section and partially broken away, of the coaxial cable connector of FIGS. 3-5, in relation to an external interface port that is partially engaged therewith.

Still referring mainly to FIGS. 3 and 4, the coupling nut 240 has a first end 242 and an opposing second end 244. According to this embodiment, the coupling nut 240 further includes a set of internal threads 245 that extend over at least an axial portion thereof between a pair of end flanges 246, which can be preferably beveled. The coupling nut 240 is mounted in overlaying fashion onto the first end of the post 230 and adjacent the first end 222 of the connector body 220 and is movably (axially) and rotatably attached for limited axial movement, as shown in FIG. 6. The threaded nut 240 may be formed of both conductive materials and non-conductive materials, or a combination of each, wherein the exterior surface 247 of the nut can be knurled, as depicted herein, in order to facilitate ease of use.

The peripheral wall of the post socket 236 further includes an interior surface 233 that is sized to receive the distal mating end 272 of an external coaxial cable interface port 270, such as an appliance including a television, computer, modem or other suitable device, or a port for a coaxial cable communications device or other communications component such as a line splitter extender or the like, the port acting as a connective element thereof. As defined herein and referring to the cutaway assembly view of FIG. 6, the external interface port 270 includes a conductive receptacle 271 that is configured for receiving the axial extending portion of the center conductor 18 of the prepared coaxial cable end 10 wherein the conductive receptacle enables adequate electrical contact therewith. The external interface port 270 is further defined by a threaded exterior surface 274 that extends substantially over its axial length, including the mating distal end 272 thereof. For purposes of this discussion, the threads of the exterior surface 274 of the port 270 can be configured with a suitable pitch and height based upon known industry standards as can other dimensional parameters of the interface port 270 and the conductive receptacle 271, including, but not limited to, the diameter and length thereof. As to the construction of the external interface port 270, single or multiple conductive materials can be used in total or in part provided a suitable electrical interface is established between the center conductor 18 of an engaged coaxial cable end 10 and the conductive receptacle 271, the latter of which is made from a conductive material.

Figure 7:
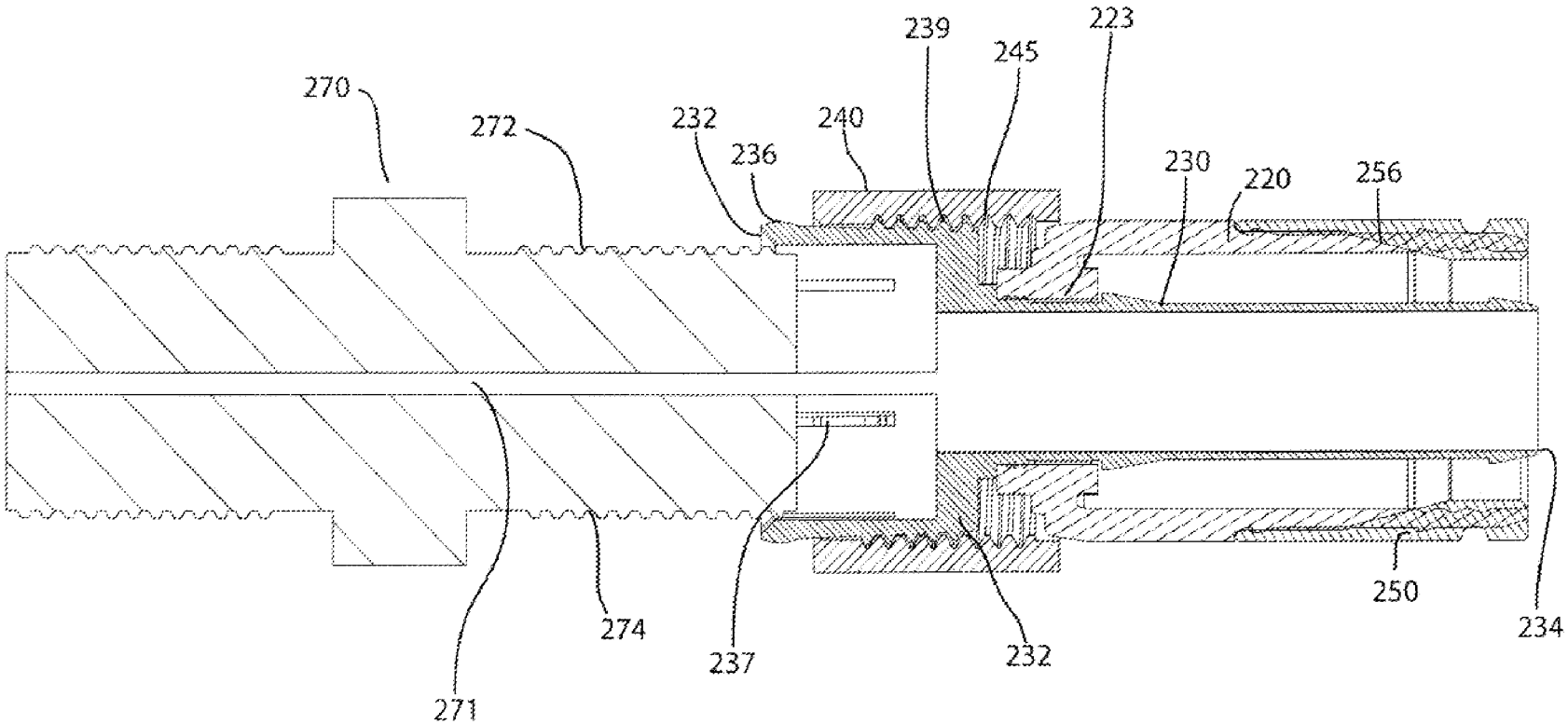
FIG. 7 is a side sectioned view of the coaxial cable connector of FIGS. 2-6, as shown in a partially engaged position with the external interface port.

As to the assembly of the connector components and referring to FIGS. 6 and 7, the second end 234 of the post 230 is disposed into the confines of the connector body 220 wherein a portion of the exterior surface along an intermediate section thereof is engaged for securement by the post mounting portion 223, maintaining the post both axially as well as rotationally relative to the herein described connector 200. A prepared coaxial cable end 10 (partially shown) is inserted into the second end 224 of the connector body 220 and into engagement with the second end 234 of the post 230, which engages the cable end 10 between the cored intermediate dielectric layer 16 and the conductive shield layer 14, creating an electrically grounded connection. Please note that the stripped portions 12 and 14 of the inserted coaxial cable 10 are not shown in these assembled views for the sake of clarity. The interior of the connector body 220 is sized to permit the shielding layer 14 and outer sleeve 12 to be retained therein. Securement by means of axial displacement of the compression member 250 causes compression of the deformable portion 226 due to the size mismatch between the interior ramped surface 256 of the compression member 250 and the exterior surface of the connector body 220, thereby securing the coaxial cable end 10 in place, with the extending portion of center conductor 18 extending through the center passageway 225 of the connector body 220 and the post 230 and into the socket 236 of the flanged first end 232 of the post 230.

Following securement of the prepared coaxial cable end 10 within the connector as described above, an external interface port 270 is then aligned with the herein described coaxial cable connector 200. More specifically, the distal mating end 272 and conductive receptacle 271 of the engaged interface port 270 are axially aligned with the coupling nut 240 such that the port is initially positioned adjacent the socket 236 of the post 230 with the center conductor 18 of the cable end 10 being aligned with the conductive receptacle 271 of the engaged interface port 270.

Once aligned and as shown in FIGS. 6-10, the coupling nut 240 can be threadingly advanced by rotating the nut 240 in a counterclockwise direction, according to this exemplary embodiment, axially advancing the coupling nut along the engaged interface port 270. As the coupling nut 240 is rotated along the external threads 239 of the socket 236, the spring fingers of the socket 236 are caused to radially extend inwardly, engaging into intimate contact against the exterior threads of the distal end of the advancing interface port 270. As such, securement can be made without concerns as to the specific diameter of the engaged interface port 270, as opposed to prior art coaxial cable connectors of this type, such as those previously described in regard to FIGS. 1 and 2. Additionally and although the majority of present interface ports are threaded, such threading is not entirely necessary for engagement to the present connector.

Figure 8:
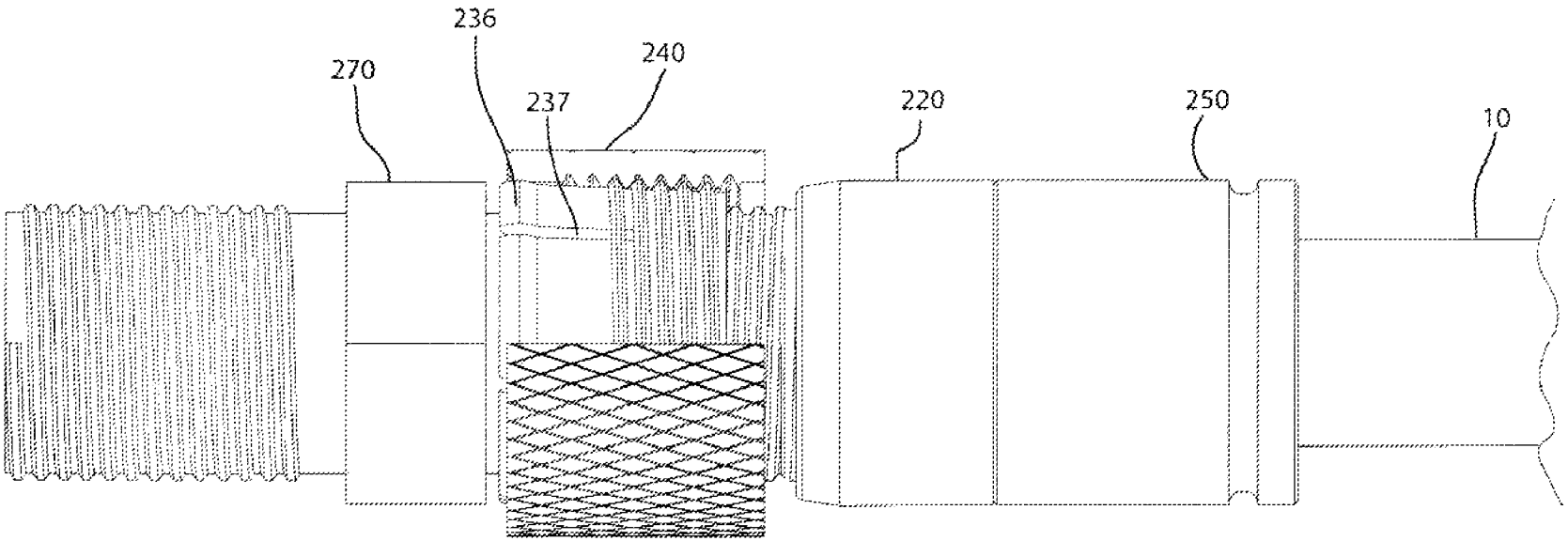
FIG. 8 is a side elevational view, partially broken away, of the connector of FIGS. 3-7 with an interface port fully engaged therewith.
Figure 9:
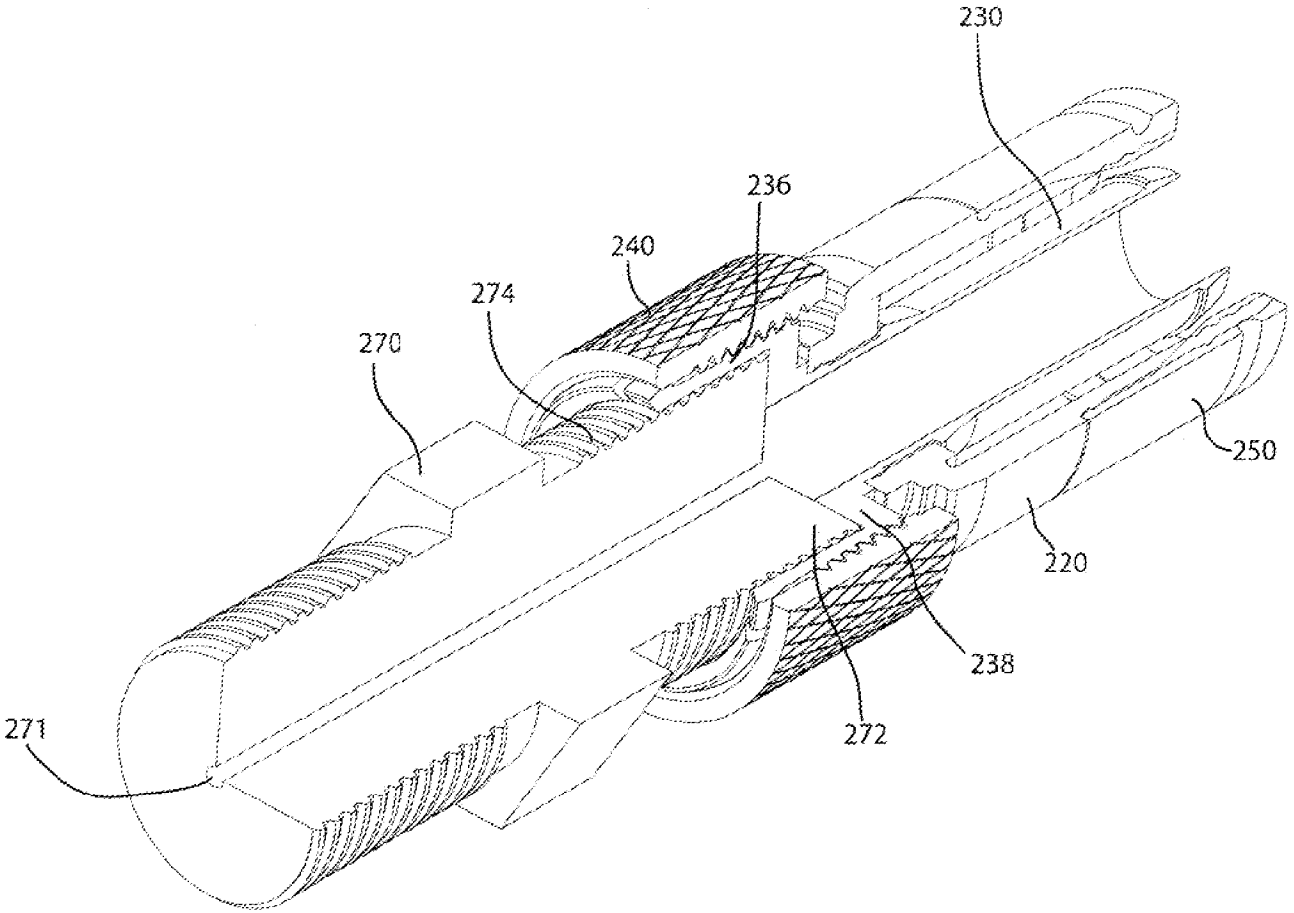
FIG. 9 is the side perspective view of the coaxial cable connector of FIGS. 3-8, depicting the fully engaged interface port with the connector.
Figure 10:
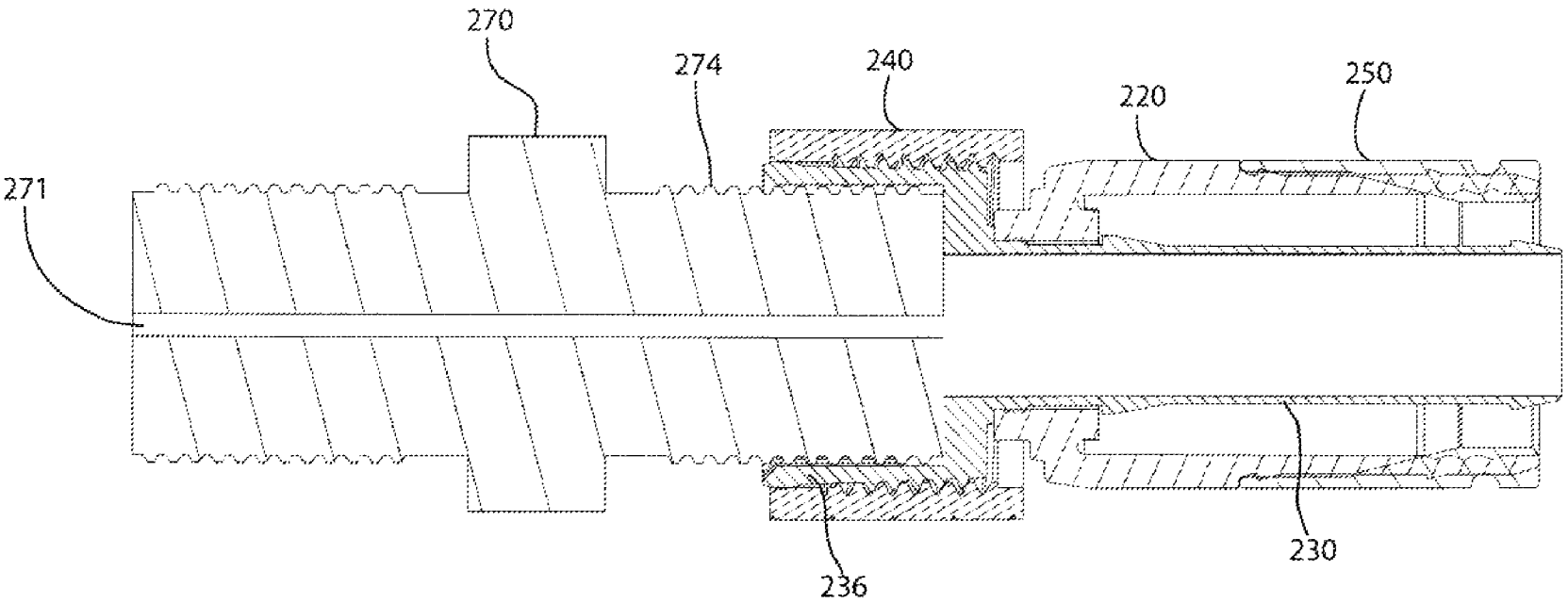
FIG. 10 is a side sectioned view of the coaxial cable connector of FIGS. 2-9, as shown in the fully engaged position with the interface port.

FIGS. 6 and 7 depict partial engagement of the interface port 270 with the herein described coaxial cable connector 200, while FIGS. 8-10 depict the interface port 270 in an fully engaged position with the coaxial cable connector 200. In the latter position, the radial end edge of the connector 200 is in compressive contact with the end flange 238 of the post socket 236. Electrical continuity is already assured, however, based on the contact with the interior surface 233 of the attached socket 236.

In the partially engaged position shown in FIGS. 5 and 6, the distal end 272 of the interface port 270 is initially received by the open-ended socket 236. The interior diameter of the socket 236 is sized so as to produce intimate contact with the threaded surface of the engaged port 270, wherein the spring fingers that are defined by the socket 236 produce radial compressive pressure therewith, but not enough pressure to prevent rotation of the coupling nut 240. As the coupling nut 240 is tightened by rotation in the counterclockwise direction according to this exemplary embodiment, the engagement between the exterior threads of the socket 236 and the interior threads of the coupling nut 240 cause the distal end 272 of the port 270 to be drawn down and advanced in an axial direction toward the extending portion of the center conductor 18. Advancement continues in this axial direction until the radial end edge of the external port 270 engages and is caused to be in compressive contact with the radial end edge 238 of the post flange, forming the proximal end of the socket 236, as shown in FIGS. 8-10. The interface port 270 can also be released by reversing the direction of rotation of the coupling nut 240 relative to the socket 236 (i.e., in the clockwise direction), thereby backing the port from the herein described connector 200.

PARTS LIST FOR FIGS. 1-10

10 coaxial cable end
11 longitudinal axis, connector
12 outer conductor
14 grounding shield layer
16 intermediate dielectric layer
18 center conductor
20 external port

23 set of threads
30 nut, threaded
31 first end
32 second end
33 internal threads
34 internal lip
35 flange
40 post
41 first end
42 first end
43 flange
44 shaft
47 tapered portion
50 connector body
51 first end
53 annular detent
55 compliant outer surface portion
57 post mounting portion
58 annular recess
59 annular serrations
60 compression member
61 first end
62 second end
65 center passageway or bore
66 transitional section
67 first diametrical section
68 second diametrical section
69 exterior surface feature
80 body sealing member
100 connector, coaxial cable
200 connector, coaxial cable
211 longitudinal or primary axis, connector
220 body, connector
222 end, first
223 post mounting portion
224 end, second
225 center passageway
226 deformable portion
229 annular serrations
230 post
232 first end
233 interior surface
234 second end
235 mating edge
236 open-ended post retaining portion or socket
237 axial slots
238 radial mating edge
239 threads
240 nut, coupling
242 first end
244 second end
245 interior threads
247 exterior surface
250 compression ring or sleeve
252 first end
254 second end
255 center passageway
256 ramped interior surface
270 port, exterior or equipment
271 conductive receptacle
272 distal mating end
274 externally threaded section It will be readily apparent from the foregoing discussion that other modifications and variations are possible within the inventive concepts described herein and according to the following claims.

The invention claimed is:

1. A connector for a coaxial cable, said connector comprising:

a post having a first end, a second end, and an exterior surface;

a connector body having a post mounting portion configured to mate with the exterior surface of the post;

a coupling nut rotatably attached to the first end of said post, said coupling nut including a set of internal threads, said first end of the post further including a open-ended port retaining portion defining a locking collet, at least an axial section of said port retaining portion including external threads engageable with the internal threads of said coupling nut, thereby enabling various sized external ports to be engaged with said connector.

2. A connector as recited in claim 1, wherein the second end of said post extends into a center passageway of said connector body and is axially secured therein.

3. A connector as recited in claim 1, wherein said connector is an F-type connector.

4. A connector as recited in claim 1, further including a compression member for securing a coaxial cable end within said connector body.

5. A connector as recited in claim 1, wherein said open-ended port retaining portion is made from an electrically conductive material such that electrical continuity is created and maintained when said external port is initially engaged therewith.

6. A connector as recited in claim 1, wherein said port retaining portion comprises a socket having a peripheral wall and cylindrical receiving cavity, said socket including a plurality of spring fingers defined by axial slots disposed in said peripheral wall.

7. A coaxial cable connector comprising:

a connector body including a hollow interior that is sized to receive a prepared coaxial cable end, wherein the connector body includes a post mounting portion;

a post having a pair of opposing ends in which one of said ends is sized to be fitted into said connector body for engaging said coaxial cable end for securement thereto, said post being rotatably and axially secured in relation to said connector body at said first end, said remaining end of said post including an open-ended port retaining portion, wherein the post mounting portion of the connector body is configured to mate with an exterior surface of the post; and a coupling nut rotatably attached to the exterior of said open-ended retaining portion, said coupling nut including a set of interior threads for engaging external threads on said open-ended port retaining portion, said port retaining portion defining a locking collet that is configured for engaging an external interface port wherein rotation of said coupling nut in a tightening direction causes said collet to engage upon and secure said port.

8. A connector as recited in claim 7, wherein said open-ended port retaining portion comprises a socket, said socket having a peripheral wall and a cylindrical receiving cavity, said socket further including a plurality of circumferentially spaced axial slots.

9. A connector as recited in claim 7, wherein said connector is an F-type connector.

10. A connector as recited in claim 7, wherein said open-ended port retaining portion is made from an electrically conductive material.

* * * * *